United States Patent [19]

Taniyama

[11] 4,040,319

[45] Aug. 9, 1977

[54] CUTTER FOR CUTTING VEGETABLES AND FRUITS, THE CUTTER HAVING BLADES THAT ARE MOVABLE AT THE TIME OF CUTTING

[76] Inventor: Masayo Taniyama, 1347 Fuchu, Wakayama, Wakayamaken, Japan

[21] Appl. No.: 622,736

[22] Filed: Oct. 15, 1975

[51] Int. Cl.[2] ..... B26D 4/06; B26D 5/22

[52] U.S. Cl. ..... 83/425.3; 83/428; 83/588

[58] Field of Search ..... 83/425.2, 425.3, 428, 83/588, 856, 857, 858

[56] References Cited

U.S. PATENT DOCUMENTS

| | | | |
|---|---|---|---|
| 28,419 | 5/1860 | Trissler | 83/428 X |
| 1,748,997 | 3/1930 | Rentos | 83/425.3 X |
| 2,283,030 | 5/1942 | Bakewell | 83/425.3 X |
| 3,167,102 | 1/1965 | Vinette | 83/425.2 X |
| 3,605,840 | 9/1971 | Morrett | 83/425.3 |
| 3,807,266 | 4/1974 | Camp | 83/425.3 X |

*Primary Examiner*—Frank T. Yost
*Attorney, Agent, or Firm*—McGlew and Tuttle

[57] ABSTRACT

The cutter comprises a cutter body having an upper support surface formed with an elongated rectangular opening with inwardly extending rails on the opposite longer sides of the opening and on one end of the opening. An open rectangular support frame is engageable with the rails and has a length less than that of the opening, for reciprocation along the rails, and coil springs, engaged in recesses in one end of the rectangular opening bias the support frame to engage the other end of the opening. An open rectangular blade frame is removably and conformingly seated in the opening of the support frame, and has a plurality of cutting blades extending longitudinally across the opening therein in equispaced substantially parallel relation. A pressing cover is hinged at one end to the cutter body and has a free end provided with an operating handle, and the pressing cover has projections on its inner surface engageable through the spaces between the cutting blades. The end of the support frame opposite that engaged by the coil springs is formed with downwardly and outwardly tapered grooves, and the cover, adjacent its free end, is provided with wedges engageable in the groove. When a vegetable or fruit to be cut is placed on the blades and the cover is pressed down, the article to be cut is cut due to the pressure exerted by the pressing cover and, at the same time, the engagement of the wedges with the tapered grooves forces the support frame to move longitudinally of the opening in the support surface against the bias of the coil springs, so that the blades exert a moving cutting action on the article to be cut at the same time as the projections on the inner surface of the cover force the article between the blades. A second open rectangular blade frame is provided with cutting blades extending transversely across its opening in equispaced substantially parallel relation. For cutting a vegetable or the like into square pieces, the two blade frames may be superposed on each other and mounted in the support frame. In this case, the cover does not have the wedges, so that cutting into squares is effected by downward pressure exerted by the pressing cover without any movement of the support frame and the blade frames. The projections on the inner surface of the cover are preferably square so as to be engageable in the square recesses defined by the two sets of blades.

5 Claims, 11 Drawing Figures

CUTTER FOR CUTTING VEGETABLES AND FRUITS, THE CUTTER HAVING BLADES THAT ARE MOVABLE AT THE TIME OF CUTTING

FIELD AND BACKGROUND OF THE INVENTION

The present invention is concerned with a cutter for cutting vegetables and fruits into fine strips or squares. With the cutter of the present invention, vegetables and fruits (material to be cut) that are to be cut are placed on the blades, and a pressing cover, one end of which is hingedly attached to the cutter body, is pushed down on exert force to the material to be cut, with the blades being moved, simultaneously with the pressing force, by cams on the press cover, and the material is cut.

According to the conventional cutters of this type, a downward pressure is exerted, by means of a pressing plate, onto the material to be cut, whereby the material is cut relying only upon the downward force, with the material and the blade being in a stationary state. Therefore, it is hard to cut fibers of the vegetables.

SUMMARY OF THE INVENTION

According to the present invention, the blades are moved at the time of cutting, making it possible to very easily cut fruits as well as vegetables having fibers. With the cutter of the present invention, the pressing cover can be replaced by a pressing cover not having any blade moving means. By superposing two blade frames, one having blades extending longitudinally and the other having blades extending transversely, in cooperation with a pressing cover not having any blade moving means, the material may be cut into squares.

For an understanding of the principles of the invention, reference is made to the following description of a typical embodiment thereof as illustrated in the accompanying drawings.

DESCRIPTION OF THE PREFERRED EMBODIMENT

Figure 1:
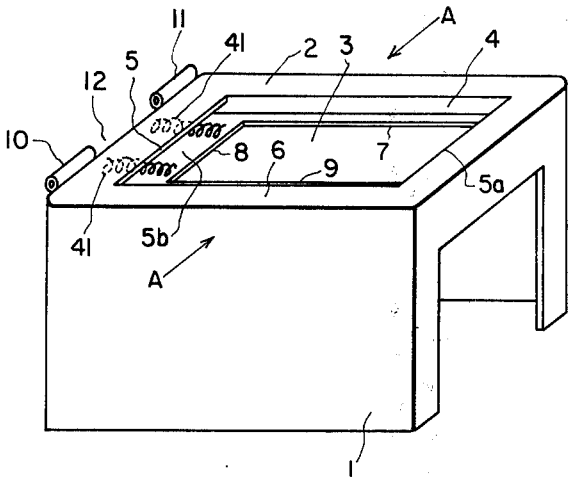
FIG. 1 is a perspective view of the cutter body from which the press covering and blades have been removed.

An embodiment of the present invention is described below with reference to the accompanying drawings. The reference numeral 1 represents a cutter body having a cross-sectional arch shape as cut across the line A—A. The cutter body 1 has a rectangular opening 1 at the center on the surface plate 2. Rails 7, 8 and 9 extend inwardly from both sides 4, 6 and rear end 5 of opening 3 in a horizontal plane. The rear end edge 5 is positioned a little behind the rail 8, and a hollow part **5*b* is defined between the rear end edge 5 and the rail 8. Hollow part 5*b* contains a number of coil springs 41. The opening 3 holds a moving or support frame 13 that will be mentioned later, and is of a size that permits frame 13 to move back and forth in the cutter on the rails. At the back of the cutter body there is formed a space 12 between hinge rings 10, 11 to receive a hinge ring 30** of the pressing cover.

Figure 2:
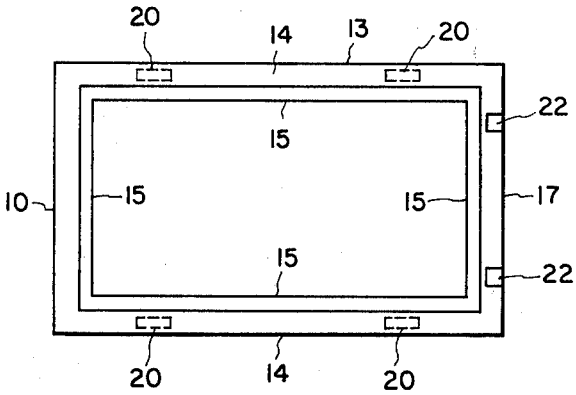
FIG. 2 is a plan view of a moving frame, in which rolls are indicated by dot-dash lines.

The moving or support frame 13 is of an open rectangular shape as shown by FIG. 2, and is of a size to be received in the opening of the cutter body. The open rectangular frame 13 is formed with steps or ledges 15 on its inner periphery, and its side members 14 and rear member 16 have a Z-shape in cross-section to form a base 18 which has a downwardly and inwardly facing outer recess 19. Rolls 20 are rotatably mounted in the side members 14 so that their lower surfaces 21 extend slightly below the upper edge of the ledges 19 to engage the rails 7 and 9 of the cutter body.

Figure 5:
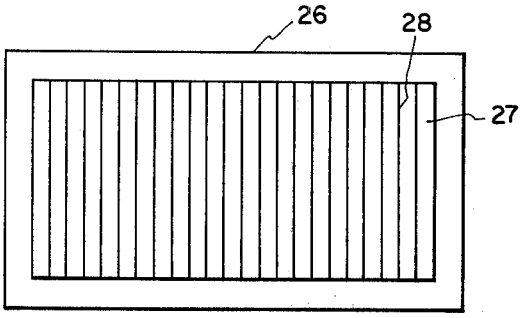
FIG. 5 is a plan view of a blade frame in which the blades are provided in the lateral direction.

Downwardly and outwardly sloping guide grooves 22 are formed in the upper outer portion of front end member 17 of frame 13. The reference numeral 23 indicates a blade frame which is of open rectangular form and is of a size to fit on the inner step 15 of moving frame 13. The blade frame 23 is equipped with a number of blades 25 in parallel in the lengthwise direction at equal spacings 24 between its inner walls. The open rectangular blade frame 26 shown in FIG. 5 is also equipped with blades 28 extending laterally across its opening at equal spacings 27.

Figure 6:
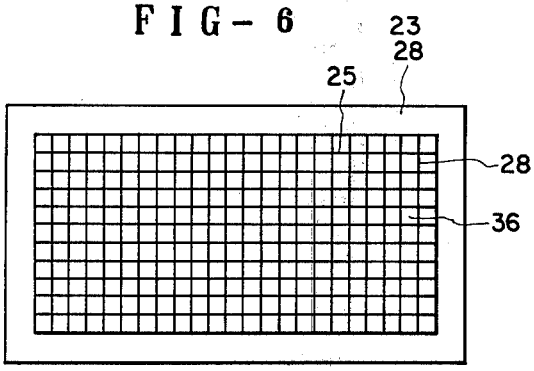
FIG. 6 is a plan view in which the blade frame of FIG. 4 and the blade frame of FIG. 5 are superposed in a crossed manner.
Figure 7:
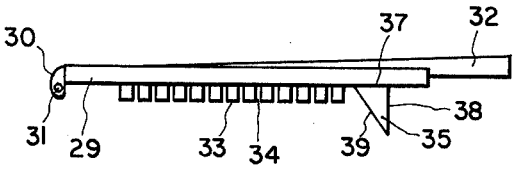
FIG. 7 is a side view of the press covering.
Figure 8:
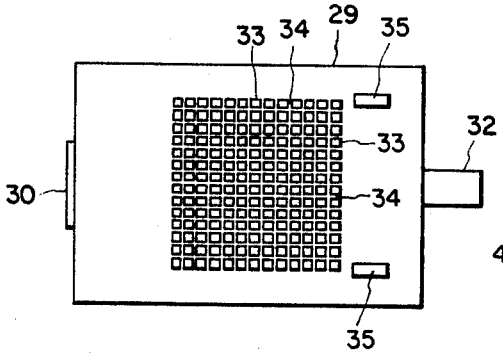
FIG. 8 is a plan view when the press covering is viewed from the inner side thereof.

Referring to FIGS. 7 and 8, the reference numeral 29 indicates a pressing cover having an area nearly equal to the surface area of the cutter body 1, and has a hinge ring 30 with a bore 31 at the rear part thereof, and also has a handle 32 firmly attached onto the surface. The numeral 33 represents projections engageable into the clearances 24 defined by the blades 25, 25 of the blade frame 23 of FIG. 4, into the clearances 27 defined by the blades 28, of blade frame 26 of FIG. 5 and into square clearances 36 defined by longitudinal blades 25 and lateral blades 28 and formed by superposing the blade frames 23 and 26 in a crossed manner as shown in FIG. 6. Between adjacent projections 33 there is formed a space 34 which will receive the blades 25 and 28, and the projections 33 are arrayed to form equal spaces 34 in the lateral and longitudinal directions. The reference numeral 35 indicates pressing plate cams or wedges at the positions corresponding to the guide grooves 22, 22 that are formed at the front side 17 of the moving frame 13, and in which the base 37, vertical side 38 and oblique side 39 form a scalene triangle, with the oblique side 39 directed inwardly.

Figure 4:
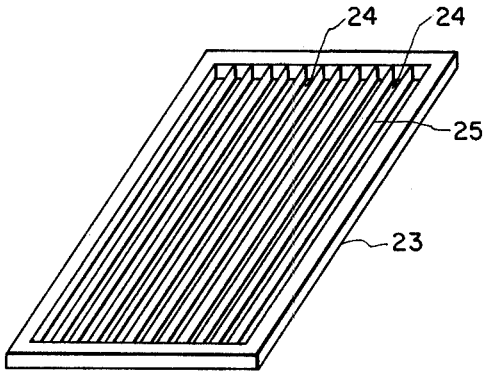
FIG. 4 is a perspective view of a blade frame in which the blades are provided in the lengthwise direction.
Figure 3:
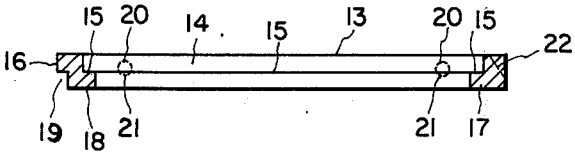
FIG. 3 is a cross-sectional view of the moving frame of FIG. 2.
Figure 9:
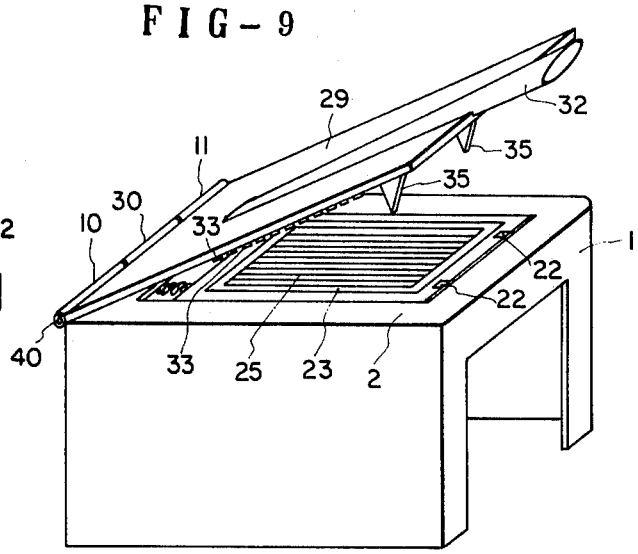
FIG. 9 is a perspective view in which the moving frame of FIG. 2 and the blade frame of FIG. 4 are mounted on the cutter body of FIG. 1, and the press covering of FIG. 7 is hingedly attached thereto and is open.
Figure 10:
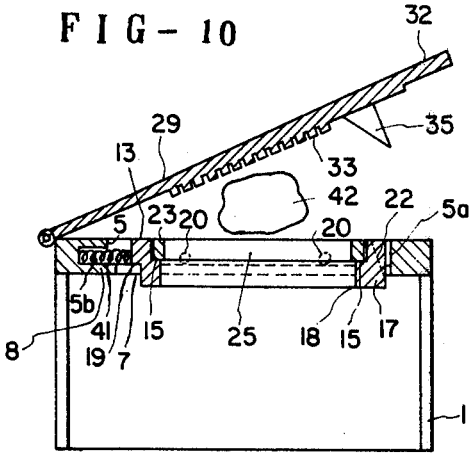
FIG. 10 is a cross-sectional view of the cutter of FIG. 9 in the lengthwise direction.

FIG. 9 is a perspective view in which the moving frame 13 of FIGS. 2 and 3 is placed on the rails 7, 8 and 9 in the opening 3 of the cutter body, a blade frame 23 of FIG. 4 is mounted on the inner step 15 of the moving frame 13, and a hinge ring 30 of the press covering 29 is inserted in the space 12 between the hinge rings 10, 11 of the cutter body, to hingedly attach the pressing cover 29 by means of a hinge pintle 40.

Figure 11:
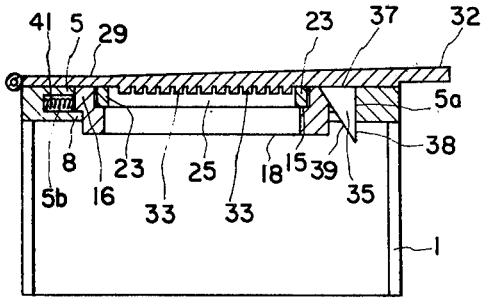
FIG. 11 is a cross-sectional view in which the press covering is closed, and the moving frame and blade frame are moved.

When the press covering 29 is open, the moving frame 13 and the blade frame 23 are pushed toward the front inner side 5*a* of the cutter body 1 due to the bias of the coil springs 41. When it is intended to cut the material 42, the material 42 to be cut is placed on the blades 25, and the pressing cover 29 is pressed downwardly toward the blades 25 by gripping a handle 32. The material 42 to be cut is pressed against the edges of the blades 25, and at the same time, the cams or wedges 35 enter the guide grooves 22 of the moving or support frame 13. The moving frame 13 is pushed backward due to the oblique sides 39 of the cams or wedges 35, against the bias of coil springs 41 as shown in FIG. 11, whereby the blades 25, moving backward, cut the material 42 that is to be cut. The blades 25, which are moving makes it possible to cut vegetables that contain fibers. In the case of cutting fibrous vegetables that are hard to cut, the press covering 29 may be moved up and down two or three times, so that the moving frame 13 is moved back and forth several times due to the coil springs 41 and the cams or wedges 35. Thus, any vegetables can be cut. Where it is intended to cut the material 42 into squares, the blade frame 23 having longitudinal blades 25 and the blade frame 26 having lateral blades 28 are superposed one above the other, so that the blades 25 and 28 are crossed. The so superposed blade frames are mounted on the moving or support frame 13, and the pressing cover having the cams or wedges 35 is replaced by a pressing cover without the cams or wedges. In this instance, support frame 13 does not move longitudinally of the cutter body, and the material is cut into squares. Furthermore, in accordance with the present invention, the rolls 20 are provided on each side of the moving frame 13, so that the lower surfaces of the rolls 20 are in contact with the rail pieces 7, 9, so that the moving frame 13 moves smoothly. Besides, the device is constructed as simple as possible, and can be manufactured inexpensively.

What is claimed is:

1. A cutter, for cutting vegetables and fruits, comprising, in combination, a cutter body having an upper support surface formed with an elongated rectangular opening; inwardly extending rails on at least the opposite longer sides of said opening; an open rectangular support frame engageable with said rails and of a length less than that of said opening, for reciprocation along said rails; means biasing said support frame to engage one end of said opening; an open rectangular blade frame removably and conformingly seated in the opening of said support frame for reciprocation with said support frame; a plurality of cutting blades extending longitudinally across the opening of said blade frame in equispaced substantially parallel relation; a pressing cover hinged at one end to said cover body and having a free end, said cover having projections on its inner surface engageable through the spaces between said cutting blades; and cooperating cam means on the free end of said cover and on an end of said support frame interengageable upon swinging of said pressing cover toward said support surface to move said support and blade frames toward the opposite end of said rectangular opening in said support surface against the bias of said biasing means; whereby, when a fruit or vegetable to be cut is placed on said cutting blades with said cover open, and said cover is swung toward said support surface, the projections on said cover press the fruit or vegetable against and between said cutting blades, and said cutting blades are moved longitudinally to effect slicing of the fruit or vegetable.

2. A cutter for cutting vegetables and fruits, as claimed in claim 1, in which said cam means comprise downwardly and outwardly sloping grooves formed in the upper and outer surfaces of that end of said support frame opposite to the end engaged by said biasing means, and cooperating wedges on said support cover engageable in said grooves.

3. A cutter for cutting vegetables and fruits, as claimed in claim 2, in which said biasing means comprises coil springs inserted in recesses formed in the opposite edge of said rectangular opening in said support surface and engaged with said open rectangular support frame.

4. A cutter for cutting vegetables and fruits, as claimed in claim 2, including rollers rotatably mounted in the opposite longer edges of said open rectangular support frame and engageable with said rails.

5. A cutter for cutting vegetables and fruits, as claimed in claim 2, in which said projections have a square cross-section whose width is substantially equal to the spacing between said cutting blades.

* * * * *